US006006377A

United States Patent [19]

Asakawa

[11] Patent Number: 6,006,377

[45] Date of Patent: Dec. 28, 1999

[54] PATIENT CARRYING DEVICE

[76] Inventor: Yoshio Asakawa, 287, Tsubukuhonmachi, Kurume-shi, Fukuoka 830, Japan

[21] Appl. No.: 08/875,660

[22] PCT Filed: Dec. 4, 1996

[86] PCT No.: PCT/JP96/03558

§ 371 Date: Jul. 29, 1997

§ 102(e) Date: Jul. 29, 1997

[87] PCT Pub. No.: WO97/20535

PCT Pub. Date: Jun. 12, 1997

[30] Foreign Application Priority Data

Dec. 5, 1995 [JP] Japan ..... 7/344451

[51] Int. Cl.[6] ..... A61G 7/10

[52] U.S. Cl. ..... 5/83.1; 5/612; 5/81.1; 5/85.1; 5/89.1

[58] Field of Search ..... 5/83.1, 612, 81.1, 5/85.1, 88.1, 86.1, 89.1; 212/315, 316, 171, 312, 321, 322, 323, 175; 424/921

[56] References Cited

U.S. PATENT DOCUMENTS

| | | | |
|---|---|---|---|
| 9,215 | 8/1852 | Hopkins | 5/85.1 |
| 560,736 | 5/1896 | Morgan | 212/316 |
| 4,372,452 | 2/1983 | McCord | 5/83.1 |
| 4,446,587 | 5/1984 | Jump | 5/83.1 |
| 4,571,758 | 2/1986 | Samuelsson | 5/83.1 |
| 4,627,119 | 12/1986 | Hachey et al. | 5/85.1 |
| 4,639,955 | 2/1987 | Carminati et al. | 5/85.1 |
| 4,944,056 | 7/1990 | Schroeder et al. | 5/85.1 |
| 5,072,840 | 12/1991 | Asakawa et al. | 212/315 X |
| 5,337,908 | 8/1994 | Beck | 212/189 |
| 5,456,655 | 10/1995 | Morris | 212/315 X |
| 5,490,293 | 2/1996 | Nilsson | 5/83.1 |
| 5,499,408 | 3/1996 | Nix | 5/83.1 |

*Primary Examiner*—Michael F. Trettel
*Assistant Examiner*—Fredrick Corley
*Attorney, Agent, or Firm*—Jordan and Hamburg LLP

[57] ABSTRACT

The object of the present invention is to provide a patient carrying device so adapted as to allow the patient take a comfortable posture or to freely carry the patient between the bed and the toilet, the bath-tub or otherwise desired locations.

The patient carrying device is provided with a first mobile vehicle 10A and a second mobile vehicle 10B, each capable of freely running along rails 4 with its second motor 12. Each of the first mobile vehicle 10A and the second mobile vehicle 10B is further provided with a rotating wheel 15 for winding up or down a suspending rope 17 and a first motor 12 for driving the rotating wheel 15. The first motor 12 and the second motor 13 are operated in a pre-programmed fashion by operating the button of a remote controller 30. Therefore, for example, when the "Bath" button 31 is operated, the first mobile vehicle 10A and the second mobile vehicle 10B are automatically operated to lift the patient and carry the patient to the bath-tub by adjusting the distance between their mobile vehicles, moving them along the rails 4, rolling up or down the suspending ropes 17 with the aid of the rotating wheels 15, and carrying out the otherwise actions.

11 Claims, 6 Drawing Sheets

PATIENT CARRYING DEVICE

The present application is a 371 of PCT/JP96/03558. Filed Dec. 4,1996 having a title of same.

BACKGROUND OF THE INVENTION

The present invention relates to a patient carrying device for carrying a patient, who cannot freely travel by oneself and keeps laying on the bed, from the bed to the bath, the wheelchair, the toilet or otherwise locations nearby the bed.

The present inventor has previously proposed a bed device for a patient who cannot travel freely from a bed (Japanese Patent Publication No. 4-78,306). As shown in this publication, the bed device comprises locating X-rails 3 and 4 and Y-rails 6 and 7 over a bed 50 and transferring an X-frame 5 and a Y-frame 8 in an X-direction and a Y-direction, respectively, thereby functioning so as to transfer a lifting apparatus 2 for lifting the patient body in the identical direction and allowing the patient to be carried to the bath-tub, the toilet or otherwise locations.

However, as the proposed bed device is structured in such a manner that the patient is allowed to travel to the objective location such as the bath-tub, the toilet, and so on, by transferring the X-frame 5 and the Y-frame 8 in the X-direction and the Y-direction, respectively, the device itself becomes so complicated in structure, large in size and heavy in weight that it is difficult to be disposed in average houses.

SUMMARY OF THE INVENTION

Therefore, it is an object of the present invention to provide a patient carrying device for carrying a patient, which is adapted to use in average houses, compact in size and easy to handle.

Briefly stated, a patient carrying device according to the present invention comprises a first mobile vehicle and a second mobile vehicle movable along rails disposed over a bed, each of the first and second mobile vehicles having a rotating wheel for winding up or down a suspending rope, a first motor for rolling up or down the suspending rope by rotating the rotating is provided wheel, a roller for adjusting a distance W between the suspending rope wound round the rotating wheel of the first mobile vehicle and the suspending rope wound round the rotating wheel of the second mobile vehicle by ratably rolling the roller, a second motor for rotating the roller, and a remote controller for controlling the first motor and the second motor of each of the first mobile vehicle and the second mobile vehicle.

DETAILED DESCRIPTION OF THE INVENTION

Figure 1:
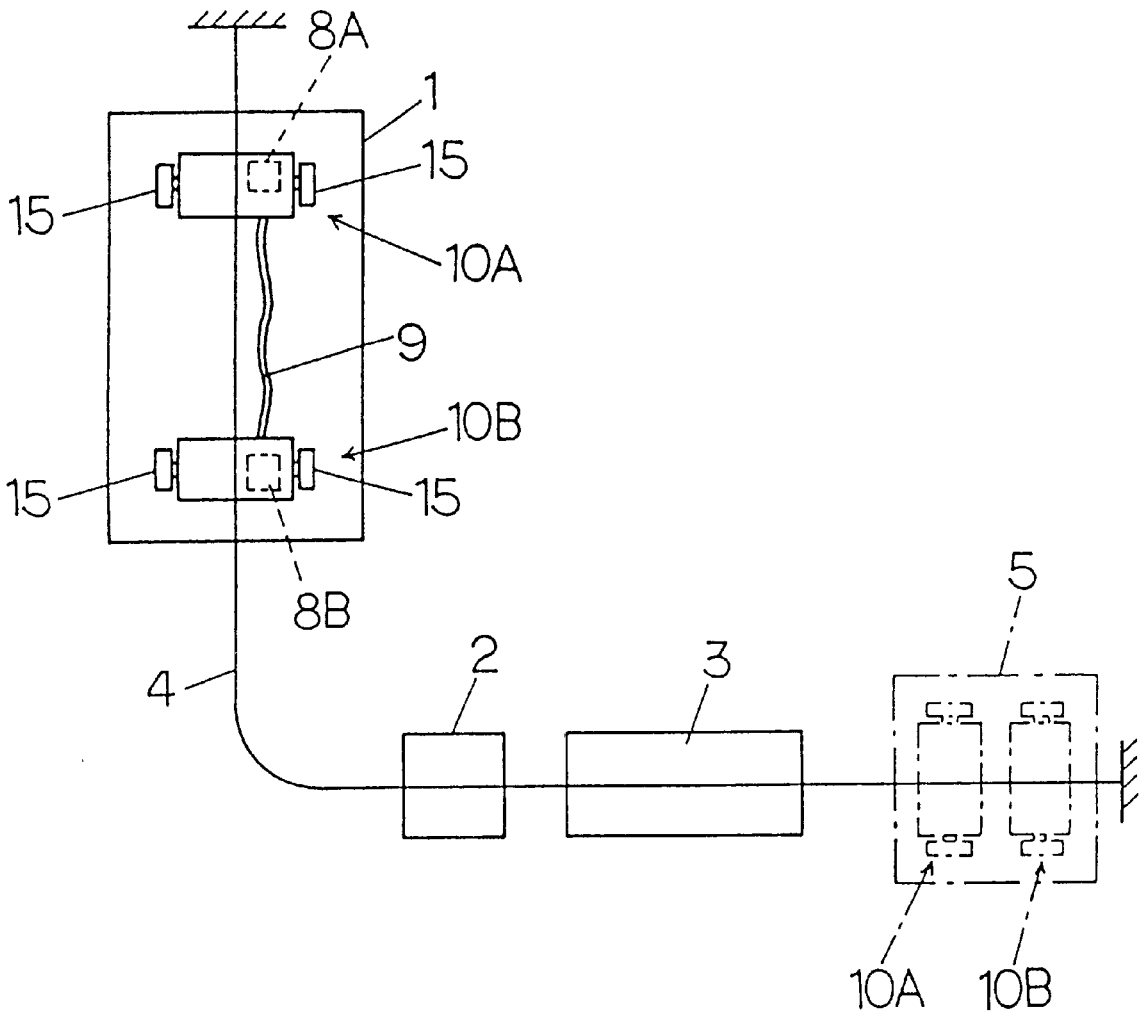
FIG. 1 is a plan view showing a sickroom.

The present invention will now be described by w,ay of examples with reference to the accompanying drawings. FIG. 1 is a plan view showing a sickroom in a house, a hospital and so on, according to a first embodiment of the present invention. In FIG. 1, reference numeral 1 stands for a bed, reference numeral 2 for a toilet, and reference numeral 3 for a bath-tub, and rails 4 are disposed over these objects. Reference numeral 10A stands for a first mobile vehicle, reference numeral 10B for a second mobile vehicle, and the mobile vehicles being disposed so as to move along the rails 4. The last end portion of the rails 4 constitutes a housing position 5 and the first mobile vehicle 10A and the second mobile vehicle 10B are resting in the housing position 5, when they are not in use. In other words, the housing position 5 is an original position from which the first mobile vehicle 10A and the second mobile vehicle 10B start operating.

Figure 2:
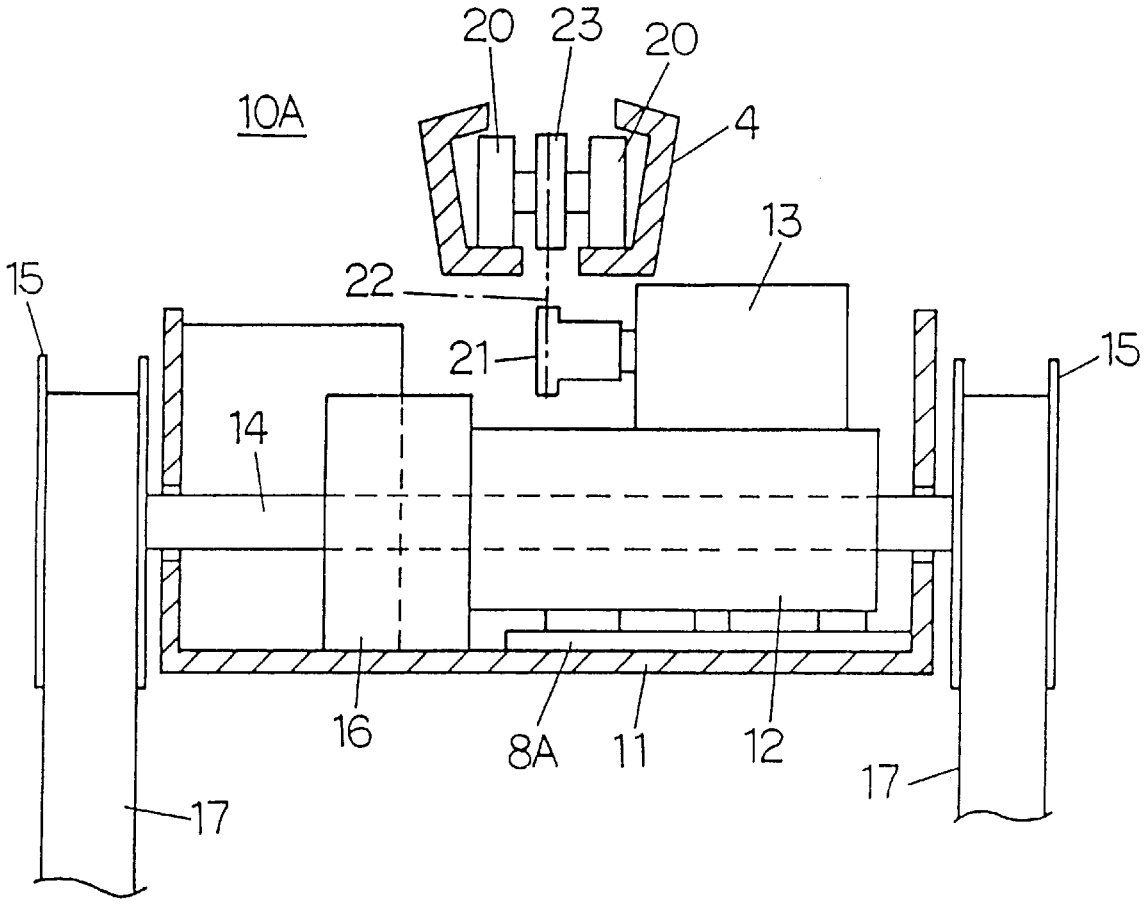
FIG. 2 is a sectional view showing a mobile vehicle.
Figure 3:
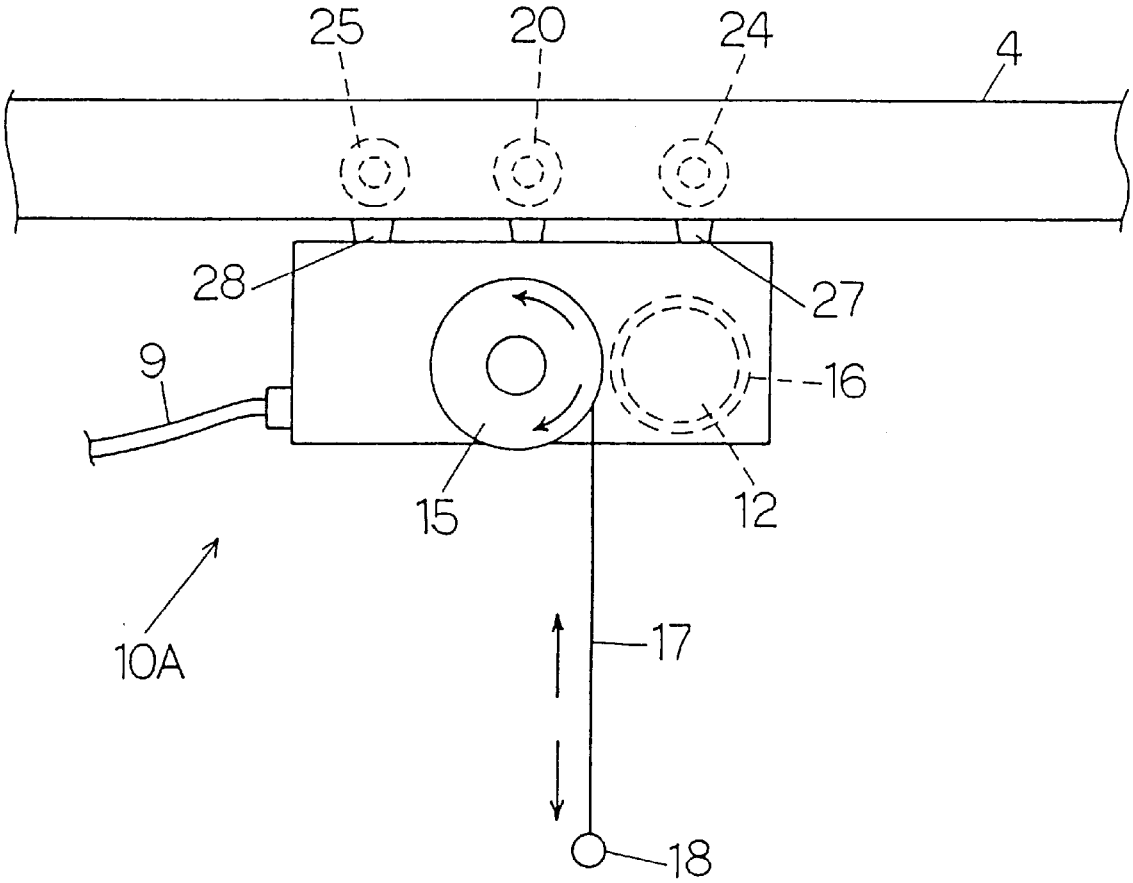
FIG. 3 is a side view showing a mobile vehicle.

FIG. 2 is the sectional view of the first mobile vehicle 10A and FIG. 3 shows the side view thereof. As the second mobile vehicle 10B has the same structure as the first mobile vehicle 10A, a description of the second mobile vehicle 10B will be omitted from the following explanation. Reference numeral 11 stands for a casing within which a first motor 12 and a second motor 13 are located, and reference numeral 14 stands for a rotary shaft disposed in a horizontal position within the casing 11. At both end portions of the rotary shaft 14 is disposed each a rotating wheel 15 such as a pulley or the like. The rotation of the first motor 12 is transmitted to the rotary shaft 14 via a gear disposed within a gear box 16. A description of a transmission mechanism from the gear box 16 to the rotary shaft 14 will be omitted from this explanation.

A suspending rope 17 is wound round the rotating wheel 15 and a weight 18 is mounted at the lower end portion of the suspending rope 17. The weight 18 is so mounted as to prevent the suspending rope 17 from swinging in an unnecessary way and to provide the suspending rope 17 with an appropriate degree of tension, thereby allowing the suspending rope 17 to be wound up and down in a smooth way by means of the rotating wheel 15.

As shown in FIG. 2, mobile rollers 20 are disposed inside the rails 4. The rotation of the second motor 13 is transmitted to the rollers 20 via a sprocket 21, a chain 22 and a sprocket 23. In FIG. 3, a follower roller 24 is located in the forward portion of the roller 20 and a follower roller 25 is located in the rearward portion thereof. The follower rollers 24 and 25 are connected to the side of the casing 11 via a frame 27 and a frame 28, respectively. This allows the rotation of the second motor 13 to rotate the rollers 20 in a normal direction or in a reverse direction, thereby rolling them along the rails 4. This causes the first mobile vehicle 10A and the second mobile vehicle 10B to travel along the rails 20.

Figure 4:
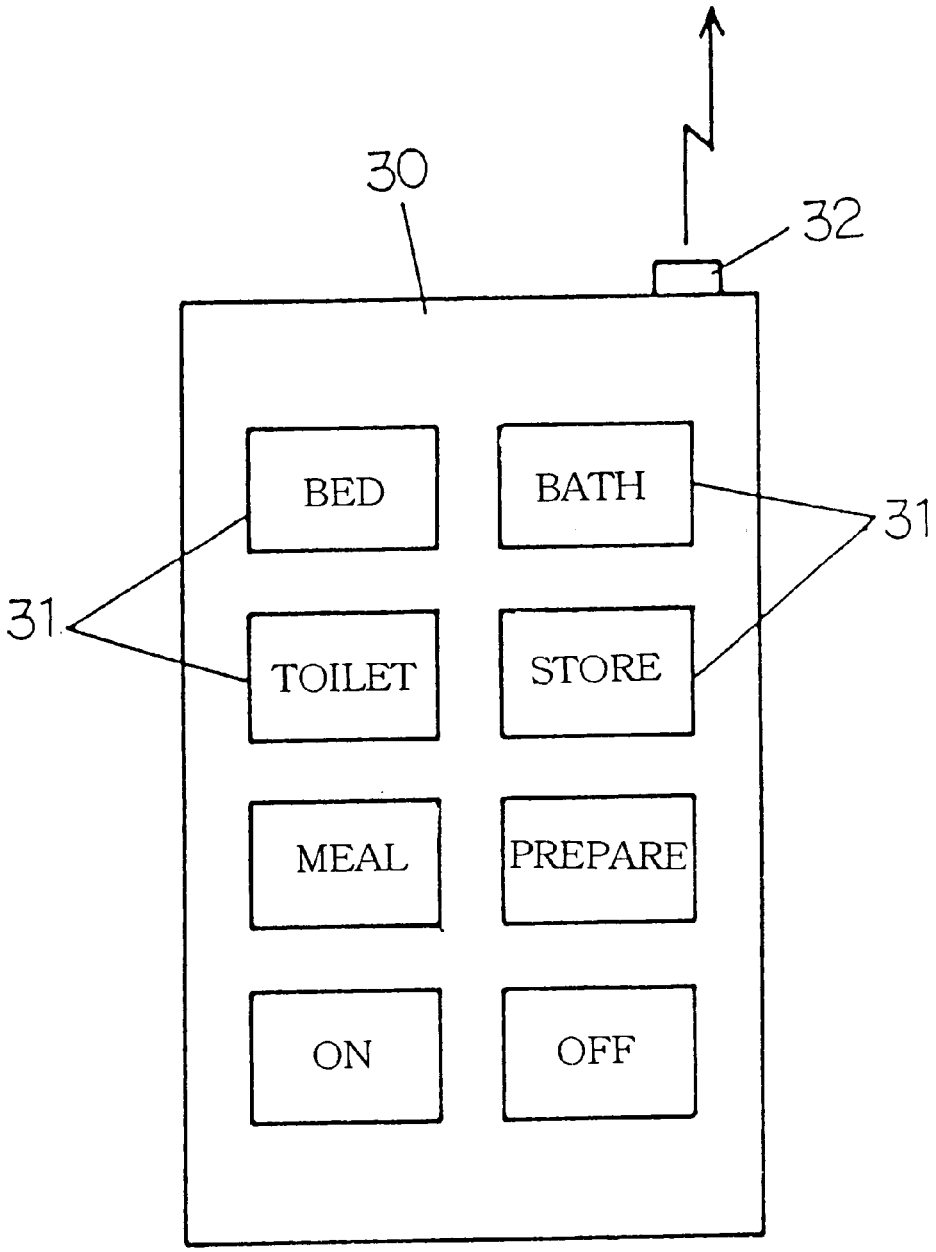
FIG. 4 is a front view showing a remote control device.

As shown in FIG. 1, the first mobile vehicle 10A is provided with a first control unit 8A and the second mobile vehicle 10B is provided with a second control unit 8B, and the first control unit 8A is connected to the second control unit 8B with a cord 9. The first control unit 8A and the second control unit 8B are arranged so as to be controllable from a remote location. FIG. 4 is the front view showing a remote controller 30. The remote controller 30 is provided with buttons 31 on each of which a function indicated by characters such as "ON", "OFF", "Bed", "Bath", "Toilet", "Prepare", "Store", etc. Upon pressing one of the buttons, 31, infrared rays are generated from an infrared lamp 32 towards the first mobile vehicle 10A and the second mobile vehicle 10B. Upon receipt of the signals generated from the remote controller 30, the first mobile vehicle 10A and the second mobile vehicle 10B are allowed to operate by the respective control units 8A and 8B in accordance with pre-program-med programs which are in advance registered in a memory each disposed in each of the control units 8A and 8B, respectively.

Now, a description will be made of the operation of the patient carrying device according to the present invention, by taking as an example a case where a patient laying on the bed 1 is carried to the bath-tub 3.

The first mobile vehicle 10A and the second mobile vehicle 10B are resting at a normal time in the housing position 5 as shown in FIG. 1. When a person taking care of the patient presses the button 31 of the remote controller 30, corresponding to "Prepare", then the second motor 13 is driven to move the first mobile vehicle 10A and the second mobile vehicle 10B to the position over the bed 1 as indicated by the solid line in FIG. 1. Then, the first motor 12 starts operating to roll the suspending rope 7 wound round the rotating wheel 15 down and to allow the weight 18 mounted at the lower end portion of the suspending rope 17 to be attached to the bed. This finishes the preparation operation. As shown in FIG. 1, two suspending ropes 17 are provided at side portions of each of the first mobile vehicle 10A and the second mobile vehicle 10B and a total number of four of the suspending ropes 17 are mounted on this device. Once the weight 18 mounted at each of the lower end portions of the suspending rope 17 is attached to the bed 1, the person taking care of the patient attaches the weights 18 to four corners of a hammock 40 (FIG. 5) disposed under the patient laying on the bed 1.

Figure 5:
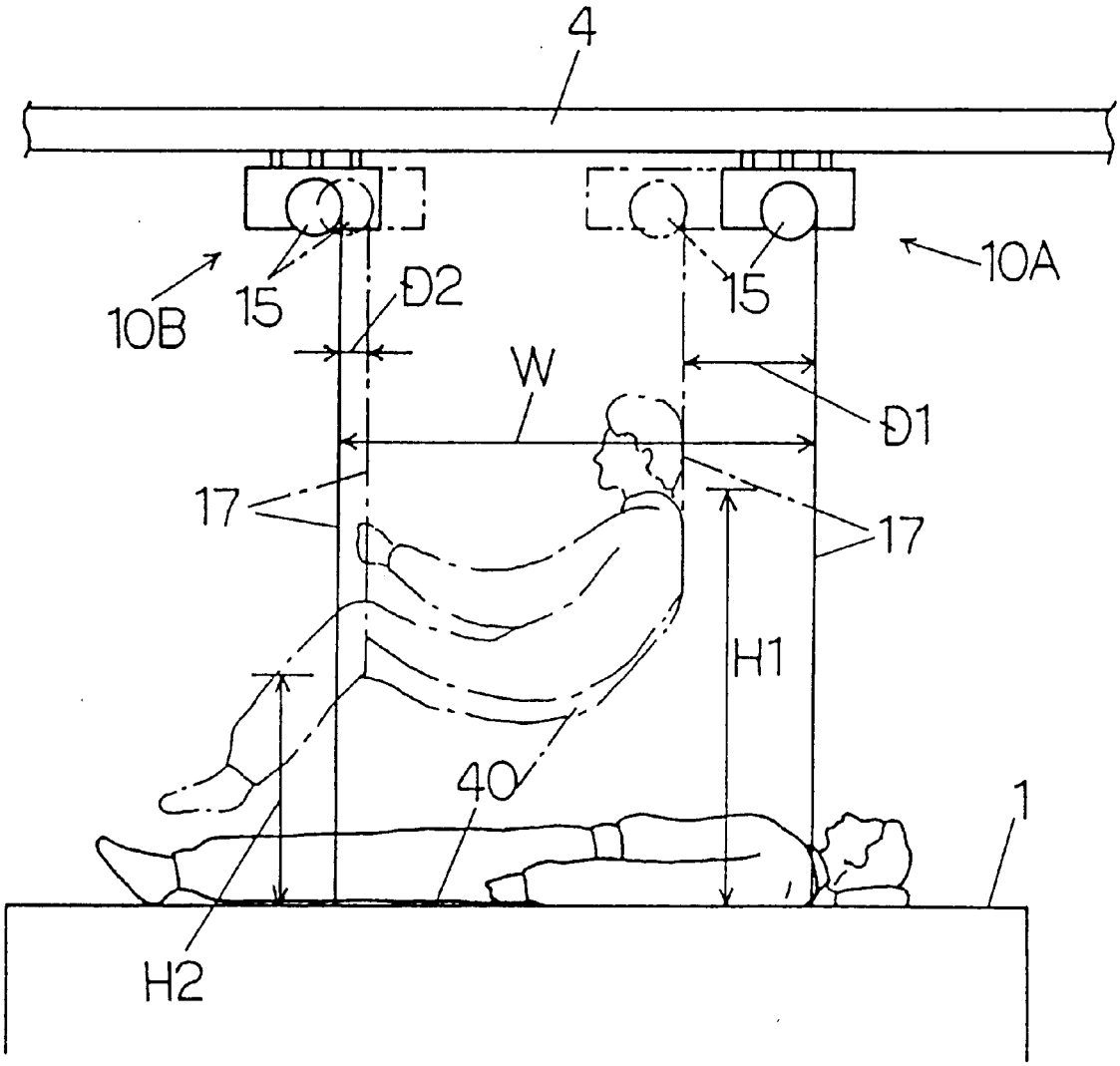
FIG. 5 is a side view showing the action of lifting a patient up from the bed.

Thereafter, for example, the person taking care of the patient presses the button 31 of the remote controller 30 indicating "Bath". The pressing of the "Bath" button 31 initiates rotation of each of the first motor 12 and the second motor 13 of each of the first mobile vehicle 10A and the second mobile vehicle 10B in a predetermined amount in a given direction, thereby shifting the state (as referred to by the solid line) in which the patient is laying on the bed 1, as shown in FIG. 5, to the state (as referred to by the dot-dash line) in which the patient is lifted over the bed 1. More specifically, upon pressing the "Bath" button 31, the first motor 12 of the first mobile vehicle 10A is rotated in the direction to wind the suspending rope 17 up to a higher position, as indicated by reference symbol H1, and the second motor 13 thereof is allowed to rotate in the direction to move the first mobile vehicle 10A to the left in a distance, as indicated by reference symbol D1. Likewise, the first motor 12 of the second mobile vehicle 10B is rotated in the direction to wind the suspending rope 17 up to a higher position, as indicated by reference symbol H2, and the second motor 13 of the second mobile vehicle 10B is rotated in the direction to move the second mobile vehicle 10B to the right in a distance, as indicated by reference symbol D2.

Once the patient is lifted up in the manner as described above as indicated by the dot-dash line in FIG. 5, the first motor 12 and the second motor 13 of each of the first mobile vehicle 10A and the second mobile vehicle 10B is rotated each in the identical amount in the identical direction, thereby carrying the patient to the position over the bath tub 3. Then, the first motor 12 of each of the first mobile vehicle 10A and the second mobile vehicle 10B is rotated in the direction opposite to the state in which to lift the patient, thereby rolling al the suspending ropes 17 down to lower the patient and place the patient in the bath-tub 3. Once the patient is allowed to be placed in the bath-tub 3, the person taking care of the patient can wash the patient.

When the patient has taken a bath, the body of the patient was dried with a bath towel and the patient was lifted through the hammock 40 from the bath-tub 3 in substantially the same manner as, the patient has been lifted from the bed 1. In this case, the first mobile vehicle 10A and the second mobile vehicle 10B are operated in the direction and way opposite to the case where the patient has been moved from the bed 1 to the bath-tub 3. When the patient has been returned to the position over the bed 1, the patient is then lowered from the lifted position as indicated by the dot-dash line in FIG. 5 to the resting position as indicated by the solid line therein. This completes a series of operations for allowing the patient to take a bath. When such a series of all the operations has been completed and the patient is allowed to be located in the resting position, then all the suspending ropes 17 are released from the hammock 40 and the button 31 indicating a "Store" operation is pressed. Upon pressing the "Store" button 31, all the suspending ropes 17 are wound up and the first mobile vehicle 10A and the second mobile vehicle 10B are moved to the housing position 5 where they wait for a future instruction. In other words, when the desired button 31 of the remote controller 30 as shown in FIG. 4 is pressed, the first motor 12 and the second motor 13 of each of the first mobile vehicle 10A and the second mobile vehicle 10B are driven and operated in a pre-programmed fashion to carry out the predetermined operation.

Although the above operation has been described by way of the example in which the patient takes a bath, the first motor 12 and the second motor 13 of each of the mobile vehicles are operated to carry out the predetermined operation in the pre-programmed fashion when the "Toilet" button, the "Meal" button or the other button is pressed. Where the "Meal" button is pressed, the device is operated so as to let the patient in the upper half part of its body arise from the bed 1 and sit on the bed 1.

In order to allow the patient to travel from the bed to the toilet, bath or other locations in a comfortable manner, it is necessary to appropriately control the height (the amount by which to lift the patient) between the bottom ends of the suspending ropes 17 on the head side of the hammock 40 and those on the leg side thereof and the distance W between the suspending ropes 17 on the head side thereof and the suspending ropes 17 on the leg side thereof, as shown in FIG. 5. The patient carrying device according to the present invention is so adapted as to adjust the height (that is, the amount by which to lift) of the bottom end portions of the suspending ropes 17 by rolling up and down the suspending ropes 17 with the first motor 12 of each of the corresponding mobile vehicles and likewise so as to adjust the distance W between the suspending ropes 17 by driving the second motor 13 of each of the corresponding mobile vehicles to move the first mobile vehicle 10A and the second mobile vehicle 10B. Therefore, the patient carrying device according to the present invention can carry the patient to the desired location or allow the patient to take a comfortable desired posture simply by operating the corresponding button 31 of the remote controller 30 once the operations of the first motor 12 and the second motor 13 of each of the corresponding mobile vehicles are pre-programmed in accordance with a variety of modes, such as "Bath", "Toilet", "Meal" and so on. The contents of the programs can be freely designed as a matter of course.

Figure 6:
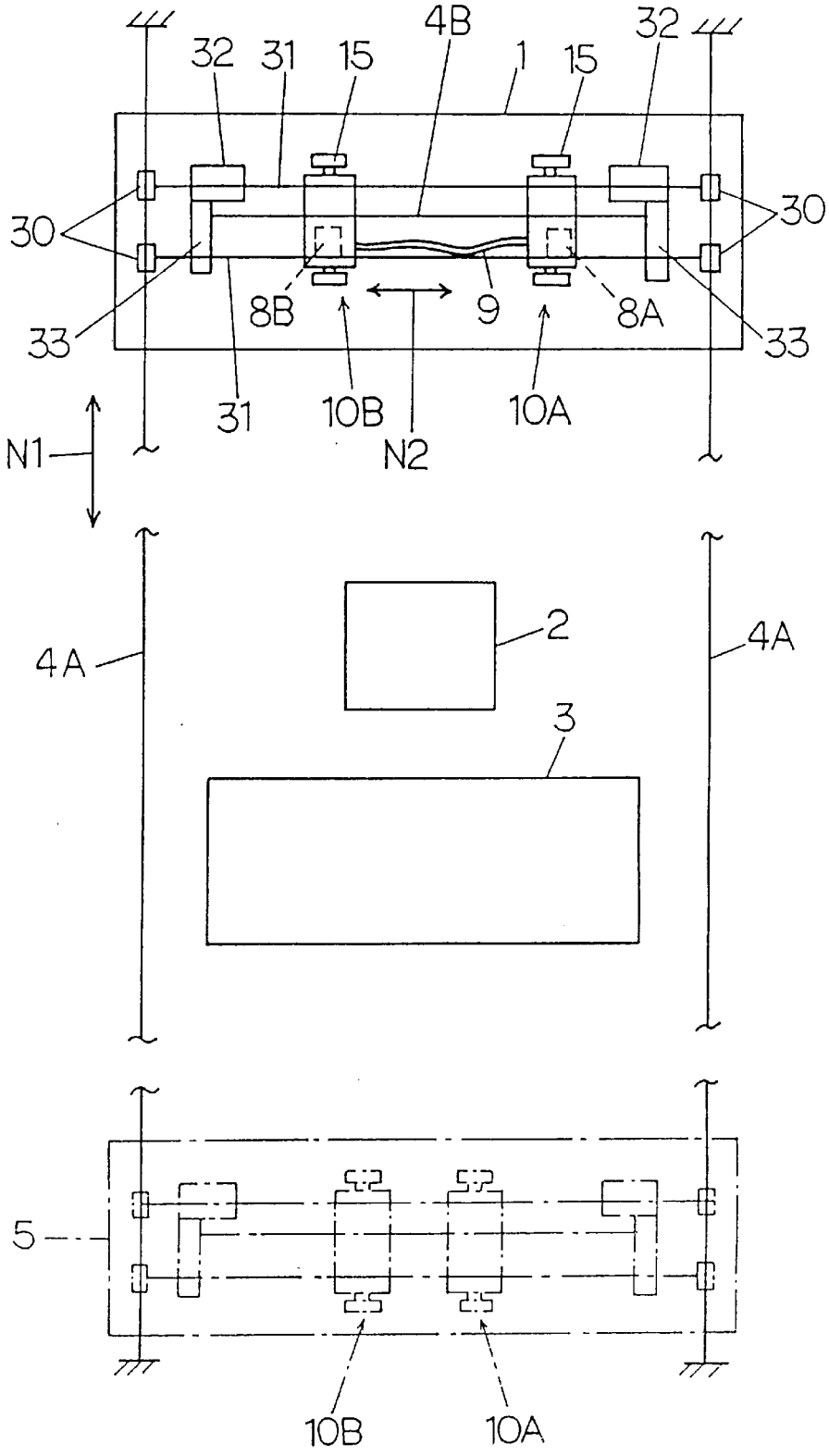
FIG. 6 is a plan view showing a sickroom.

FIG. 6 is the plan view showing the sickroom according to a second embodiment of the present invention. It is to be noted herein that, as the basic principle and construction of the second embodiment of the present invention are substantially the same as those of the first embodiment thereof, they will be described briefly and a duplicate description will be omitted by providing the same elements with the same reference numerals as with the first embodiment thereof.

In FIG. 6, reference numeral 1 stands for a bed, reference numeral 2 for a toilet, reference numeral 3 for a bath-tub, and reference numeral 5 for a housing position. Over those elements are disposed a pair of right-hand and left-hand parallel first rails 4A. Reference numeral 30 stands for rollers rolling along or on the first rails 4A in the direction as indicated by the arrow N1 and two rollers 30 for each rail 4A are disposed with a total number of four of the rollers 30. The left-hand and right-hand rollers 30 are connected to each other through a rotary shaft 31 and rotatably driven by a motor 32. Reference numeral 33 stands for a frame integral with the motor 32. The frame 33 is connected at its one end portion to the motor 32 and at its other end portion to one of the rotary shafts 31.

The left-hand motor 33 is connected to the right-hand motor 33 through a second rail 4B. It is to be noted herein that the second rail 4B corresponds to the rail 4 in the first embodiment according to the present invention. The distance of the suspending ropes 17 between the first mobile vehicle 10A and the second mobile vehicle 10B can be adjusted by moving the first mobile vehicle 10A and the second mobile vehicle 10B along the second rail 4B in the direction as indicated by the arrow N2. Each of the first mobile vehicle 10A and the second mobile vehicle 10B has substantially the same configuration as the first mobile vehicle 10A and the second mobile vehicle 10B according to the first embodiment of the present invention, respectively, and they are provided with a rotating wheel 15 to be rotated by the first motor 12 and rollers 20 to be driven by the second motor 13.

In the second embodiment of the present invention, the operation for lifting the patient up from the bed 1 or down thereto is the same as in the first embodiment according to the present invention as shown in FIG. 5, and the patient can be lifted by adjusting the distance W of the suspending ropes 17 of the first mobile vehicle 10A and the suspending ropes 17 of the second mobile vehicle 10B. When the patient has been lifted, the motor 32 is driven to move the rollers 30 along the first rails 4A so as to reach the position over the toilet 2, the bath-tub 3 or otherwise desired location. It is to be noted herein as a matter of course that the motor 32 can be controlled with a remote controller in a pre-programmed manner.

The patient carrying device according to the present invention has the first mobile vehicle 10A and the second mobile vehicle 10B, each running along rails 4, each of the first mobile vehicle 10A and the second mobile vehicle 10B being provided with the rotating wheel 15 and the first motor 12 as lifting means for lifting the patient and with the rollers 20 and the second motor 13 as running means for running the mobile vehicle. The patient carrying device can carry the patient to a predetermined location or allow the patient to take a predetermined posture in a comfortable manner simply by operating the remote controller 30. Further, as the first mobile vehicle 10A and the second mobile vehicle 10B are disposed so as to move independently from each other or to roll each of the suspending ropes 17 up and down, the patient carrying device can be operated with a high degree of freedom so as to be adapted to a variety of desired modes such as taking a bath, using the lavatory, having a meal and otherwise taking a desired action.

I claim:

1. A patient carrying device for carrying a disabled patient from a first location to a second location, comprising:

a rail system disposed above the patient over said first and second locations, and extending therebetween for carrying the patient between said first and second locations;

a rail member mounted to said rail system so as to move from said first and second locations along said rail system for carrying the patient between said first and second locations;

a first mobile vehicle mounted to said rail member so as to move between a first position and a second position along said rail member, said first mobile vehicle including a first motor driven mechanism for imparting movable travel thereto along said rail member, and said first mobile vehicle being provided with a first suspending rope for lifting the patient so as to be independently windable up and down; and a second mobile vehicle mounted to said rail member so as to move between a third position and a fourth position along said rail member, said second mobile vehicle including a second motor driven mechanism for imparting movable travel thereto along said rail member, and said second mobile vehicle being provided with a second suspending rope for lifting the patient so as to be windable up and down independently from said first mobile vehicle;

wherein said first mobile vehicle is movable between said first and second positions along said rail member by said first motor driven mechanism;

said second mobile vehicle is movable between said third and fourth positions along said rail member by said second motor driven mechanism; and said first and second mobile vehicles are operable independently from each other so as to selectively adjust a distance between said first and second suspending ropes by relative positional travel of said first and second mobile vehicles along said rail member.

2. A patient carrying device for carrying a disabled patient from a first location to a second location, comprising:

a rail system disposed over said first and second locations, and extending therebetween; and a first mobile vehicle and a second mobile vehicle movably mounted to said rail system independent of one another, said first and second mobile vehicles each including a motor driven mechanism for imparting independent movable travel thereto along said rail system continuously between said first and second locations, each of said first and second mobile vehicles being provided with a suspending rope for lifting the patient so as to be independently windable up and down, whereby a distance between both of said suspending ropes can be selectively adjusted by relative positional travel of said first and second mobile vehicles along said rail system.

3. A patient carrying device for carrying a disabled patient, comprising:

a hammock for supporting the patient;

a first mobile vehicle and a second mobile vehicle;

a rail course vertically disposed above the patient, said first and second mobile vehicles being movably mounted to said rail course independent of one another, said first and second mobile vehicles each including a motor driven mechanism for imparting independent movable travel thereto along said rail course; and each of said first and second mobile vehicles including independently operable hoist means for lifting and lowering a load attached thereto, said hoist means of both said first and said second mobile vehicles including suspending means each extending downwardly therefrom independent of one another, said suspending means being attached to said hammock at respective attachment positions therealong such that at least a portion of the patient is disposed between said attachment positions when supported by said hammock.

4. A patient carrying device in accordance with claim 3, wherein:

said hoist means each includes pulley means for altering a length of said suspending means by rotation thereof, said hoist means further including means for imparting rotation to said pulley means.

5. A patient carrying device in accordance with claim 4, further comprising means for controlling the operation of at least one of said motor driven mechanism and said means for imparting rotation in each of said first and second mobile vehicles.

6. A patient carrying device in accordance with claim 5, wherein said means for controlling include:

means for sending command signals corresponding to a desired task; and at least one control unit for converting said signals into a response of at least one of said motor driven mechanism and said means for imparting rotation in each of said first and second mobile vehicles based upon pre-programmed data representative of the desired task.

7. A patient carrying device in accordance with claim 3, wherein said hammock is flexible, selective alteration of respective lengths of said supporting means by independent operation of said hoist means of said first and second mobile vehicles, and relative positional movement of said first and second mobile vehicles with respect to one another along said rail course by independent operation of each said motor driven mechanism in respective ones of said first and second mobile vehicles, thereby controlling a suspension posture of the patient.

8. A patient carrying device for carrying a disabled patient, comprising:

a hammock for supporting the patient;

a first mobile vehicle and a second mobile vehicle;

a rail course comprised of spaced apart parallel rails, portions of said rail course being disposed above the patient;

a cross-member mounted between said parallel rails and movable along said rail course to desired positions therealong, said cross-member having an axis directed crosswise to a direction of said parallel rail at any given positional location of said cross-member therealong;

said first and second mobile vehicles being mounted to said cross-member and aligned along a common mounting axis running codirectional with said axis of said cross-member for independent movable travel therealong; and each of said first and second mobile vehicles including independently operable hoist means for lifting and lowering a load attached thereto, said hoist means including retractable and extendable means extending downwardly therefrom for attachment of hoist means to said hammock at attachment positions therealong such that at least a portion of the patient is disposed between said attachment positions.

9. A patient carrying device in accordance with claim 8, further comprising means for controlling the operation of at least one of said means for imparting primary motion, said means for imparting secondary motion, and said means for imparting rotation.

10. A patient carrying device in accordance with claim 9, wherein said means for controlling include:

means for sending command signals corresponding to a desired task; and at least one control unit for converting said signals into a motorized response of at least one of said means for imparting primary motion, said means for imparting secondary motion, and said means for imparting rotation, based upon pre-programmed data representative of the desired task.

11. A patient carrying device in accordance with claim 7, wherein said hammock is flexible, selective alteration of respective lengths of said retractable and extendable means by independent operation of said hoist means of said first and second mobile vehicles, and relative positional movement of said first and second mobile vehicles with respect to one another along said cross member, thereby controlling a suspension posture of the patient.

* * * * *